US005748108A

United States Patent [19]

Sampey et al.

[11] Patent Number: 5,748,108

[45] Date of Patent: May 5, 1998

[54] METHOD AND APPARATUS FOR ANALYZING TRAFFIC AND A SENSOR THEREFOR

[75] Inventors: Harry R. Sampey, Farmington; Jeffrey A. Geary, Normalville; James H. Schimpf, Derry, all of Pa.

[73] Assignee: Nu-Metrics, Inc., Uniontown, Pa.

[21] Appl. No.: 781,320

[22] Filed: Jan. 10, 1997

[51] Int. Cl.[6] ..... G08G 1/01

[52] U.S. Cl. ..... 340/933; 340/935; 340/941; 200/86 A; 324/253; 364/436

[58] Field of Search ..... 340/941, 933, 340/935, 936, 939; 200/85 R, 86 A, 86 R; 324/253, 254, 255, 256, 257, 258, 259; 364/436, 438, 565

[56] References Cited

U.S. PATENT DOCUMENTS

| | | | |
|---|---|---|---|
| 2,685,680 | 8/1954 | Williams | 340/38 |
| 3,040,658 | 6/1962 | Maltby | 102/18 |
| 3,582,932 | 6/1971 | Chapman | 340/258 |
| 3,644,825 | 2/1972 | Davis, Jr. et al. | 340/941 |
| 3,649,958 | 3/1972 | Koerner | 340/38 |
| 3,662,330 | 5/1972 | Meredith | 30/941 |
| 3,714,626 | 1/1973 | Koerner | 340/38 |
| 3,775,742 | 11/1973 | Koerner et al. | 340/38 |
| 3,825,889 | 7/1974 | Koerner | 340/38 |
| 3,839,700 | 10/1974 | DeLorenzo et al. | 340/941 |
| 3,943,339 | 3/1976 | Koerner et al. | 235/92 |
| 3,944,912 | 3/1976 | Angel et al. | 324/41 |
| 3,984,764 | 10/1976 | Koerner | 324/41 |
| 3,989,932 | 11/1976 | Koerner | 235/92 |
| 4,052,595 | 10/1977 | Erdmann et al. | 340/941 |
| 4,302,746 | 11/1981 | Scarzello et al. | 340/38 |
| 4,449,115 | 5/1984 | Koerner | 340/941 |
| 4,524,932 | 6/1985 | Bodziak | 246/247 |
| 4,623,842 | 11/1986 | Bell et al. | 324/245 |
| 4,724,390 | 2/1988 | Rauscher et al. | 324/344 |
| 4,851,775 | 7/1989 | Kim et al. | 324/247 |
| 4,901,334 | 2/1990 | Gibson | 377/9 |
| 4,939,459 | 7/1990 | Akachi et al. | 324/247 |
| 5,408,179 | 4/1995 | Sampey et al. | 324/253 |
| 5,491,475 | 2/1996 | Rouse et al. | 340/933 |
| 5,491,476 | 2/1996 | DiBeua | 340/933 |

*Primary Examiner*—Jeffery Hofsass
*Assistant Examiner*—Nina Tong
*Attorney, Agent, or Firm*—Webb Ziesenheim Bruening Logsdon Orkin & Hanson, P.C.

[57] ABSTRACT

A detector for detecting a characteristic and a speed of a vehicle includes a first magnetic field sensor for generating a first analog signal indicative of changes in magnetic field strength adjacent the first sensor in response to the vehicle passing. A differentiating circuit differentiates the first analog signal and produces a first output that changes binary state in response to detecting a predetermined change in the differentiated first analog signal. A counter accumulates values at a predetermined rate and a microprocessor stores values of the counter corresponding to each change in the binary state of the first output of the differentiating circuit. The microprocessor converts the stored counter values into a first time series profile corresponding to changes in the first output of the differentiating circuit and accumulates and stores a count of a characteristic of the passing vehicle based on the first time series profile. A second time series profile is produced from counter values accumulated in response to the differentiating circuit producing a second output. The second output of the differentiating circuit changes binary state in response to detecting a second analog signal output from a second magnetic field sensor spaced apart from the first magnetic field sensor. The microprocessor detects spaced equivalent positions between the first time series profile and the second time series profile and calculates a speed of the vehicle from the elapsed time between the equivalent positions. The microprocessor accumulates and stores a count of the calculated speed.

20 Claims, 5 Drawing Sheets

2
DSP
34
I/O
32
RTC
30
12
RF TRANSCEIVER
160

44
COUNTER
μP
10
1st ADC
40
1st CAPTURE CIRCUIT
42
2st CAPTURE CIRCUIT
16
2nd ADC
22
3rd ADC
26
4th ADC
MEMORY
28
KIRQ
IRST
TP1
INTERRUPT DECODER
102
TP3
20
DRY/WET
24
TEMP
18
DIGITAL POT
TP0
LEAD DIFFERENTIATOR
8
14
LAG DIFFERENTIATOR
TP2
6
LAG SENSOR
4
LEAD SENSOR
2nd REFERENCE SIGNAL
1st REFERENCE SIGNAL

METHOD AND APPARATUS FOR ANALYZING TRAFFIC AND A SENSOR THEREFOR

BACKGROUND OF THE INVENTION

1. Field of the Invention

This invention relates to methods and apparatus for detecting vehicles or other magnetically permeable masses and measuring according to number, classification and speed and/or length.

2. Prior Art

Prior art traffic counters utilize road tube detection and magnetic loop sensing to detect the presence and/or movement of vehicles. The road tube counter comprises a flexible length of pressure tubing laid across the roadway. At one end of the tube, a pressure sensor is positioned to detect changes in the air pressure as wheels compress the tube. Disadvantages of road tubes are their susceptibility to damage and wear and their inability to count low speed vehicles. Magnetic loop sensors comprise a loop or coil of wire buried in a shallow trough in the roadway. The inductance of the coil due to the disturbance of the earth's magnetic field changes when a vehicle passes by. The change in inductance can be measured electronically. Disadvantages of the magnetic loop detector include installation requires tearing up the road, the detectors are susceptible to damage upon thermal expansion of the highway and they are unable to discriminate between closely passing vehicles.

Still another type of magnetic permeable sensors is described in U.S. Pat. No. 5,408,179 to Sampey et al. In this sensor, a ferromagnetic strip has a conductive winding wrapped about it. A small permanent magnet is positioned adjacent one end of the ferromagnetic strip. The magnet biases the ferromagnetic strip in a linear portion of its BH curve where the slope is substantially linear. An electronic circuit generates an analog signal indicative of the inductance of the winding as the earth's magnetic field is disturbed. Another electronic circuit digitizes the analog signal at spaced time intervals to produce a series of digitized values. A microprocessor processes the digitized values to produce a first time series profile that characterizes the presence and/or motion of the magnetic permeable mass. Another sensor, similar to the above-described sensor, is spaced apart from the above-described sensor a fixed distance in the direction of the travel of the magnetically permeable mass. The output of the second sensor is also digitized by the electronic circuit to produce another series of digitized values. The microprocessor processes these digitized values to produce a second time series profile and determines equivalent positions in the first time series profile and second time series profile.

Due to the fact that no two sensors are alike, each ADC can have bias error and the gain of each sensor channel may not be exactly the same, in very high traffic, equivalent points of the lead profile and the lag profile cannot always be identified. When this occurs, the microprocessor discards the profiles with the resulting loss in data.

It is an object of the present invention to provide new apparatus and method for detecting characteristics of a magnetically permeable mass and detect a speed of a magnetically permeable mass. It is another object of the present invention to provide an apparatus for communicating characteristics of the mass and/or speed of the mass to a data collection computer.

SUMMARY OF THE INVENTION

In one embodiment of the present invention, an apparatus for detecting vehicles passing a fixed position is provided. In the apparatus, a first magnetic field sensor is provided for generating a first analog signal indicative of changes in magnetic field strength adjacent the first sensor in response to a vehicle passing thereby. A differentiating circuit differentiates the first analog signal and produces a first output that changes binary state in response to detecting a predetermined change in the differentiated first analog signal. A counter is provided for accumulating values at a predetermined rate. A processor stores values of the counter for each change in the binary state of the first output of the differentiating circuit. The processor also converts the stored counter values into a first time series profile. Based on a characterization of the vehicle from the first time series profile, the microprocessor accumulates and stores a count of passing vehicles. Preferably, the apparatus includes a communication circuit for wirelessly communicating the count stored therein to a remote data collector.

The apparatus may also include a second magnetic field detector for generating a second analog signal indicative of changes in the magnetic field strength at the second detector in response to vehicles passing thereby. The second detector is spaced apart from the first detector along the direction of travel of the vehicles. The differentiating circuit differentiates the second analog signal output and produces a second output that changes binary states in response to detecting a predetermined change in the differentiated second analog signal output. The processor stores a counter value for each change in the binary state of the second output of the differentiating circuit. The processor converts the stored counter values into a second time series profile and detects spaced equivalent positions in the first time series profile and the second time series profile. The processor measures elapsed time between the spaced equivalent positions and calculates the speed of the vehicle from the elapsed time between the spaced equivalent positions.

The first magnetic field sensor and the second magnetic field sensor each comprise a ferromagnetic strip having a conductive winding wrap thereabout. A permanent magnet is positioned adjacent one end of the ferromagnetic strip to bias the ferromagnetic strip in a substantially linear part of its BH curve. The magnetization of the ferromagnetic strip is selected to remain in the substantially linear part of its BH curve regardless of the orientation of the strip in the earth's magnetic field and regardless of disturbances in the earth's magnetic field. A sensing circuit is utilized to sense a changing inductance of the conductive winding in response to a moving magnetically permeable mass disturbing the earth's magnetic field adjacent the strip. The sensing circuit produces an analog signal output indicative of the changing inductance.

The processor preferably includes a capture circuit for storing the counter values corresponding to the times the output of the differentiating circuit changes binary states.

In accordance with another embodiment of the invention, a method of determining a characteristic of a magnetically permeable mass passing a fixed position is provided. In the method, a first change in the earth's magnetic field at the fixed location is detected. A first analog signal is generated corresponding to the change in the earth's magnetic field. The first analog signal is differentiated and a binary changing signal is generated that changes binary state in response to each occurrence of the slope of the differentiated first analog signal changing to zero. The times when the binary changing signal changes binary state are recorded and a first time series profile is produced from the recorded times. A determination is made whether a mass has passed the fixed location.

Additionally, the first time series profile can be compared to a stored profile and a characteristic of the mass determined from the comparison.

In accordance with another embodiment of the invention, a method of determining a speed of a magnetically permeable mass is provided. In this method, first and second changes in the earth's magnetic field at respective first and second locations are detected in response to a mass passing thereby. The first and second locations are spaced a fixed distance apart along the direction of the travel of the mass. First and second analog signals are generated corresponding to the change in the earth's magnetic fields at the respective first and second locations. The first and second analog signals are differentiated and first and second binary changing signals are generated that change binary state in response to each occurrence of the slope of the respective differentiated first and second analog signals changing to zero. The times the first and second binary changing signals change binary state are recorded and first and second time series profiles are produced from the recorded times. The first and second time series profiles are compared and equivalent positions in the first and second time series profiles are determined. The elapsed time between the first and second time series profiles is measured and the speed of the mass is calculated as a function of the elapsed time.

An advantage of the present invention is an improved apparatus and method for determining characteristics and speed of a magnetically permeable mass. Another advantage of the invention is that the characteristics and speed of the magnetically permeable mass are communicatable utilizing a radio frequency communication link. Still other advantages will come apparent upon reading and understanding the following detailed description.

DETAILED DESCRIPTION OF THE PREFERRED EMBODIMENTS

Figure 1:
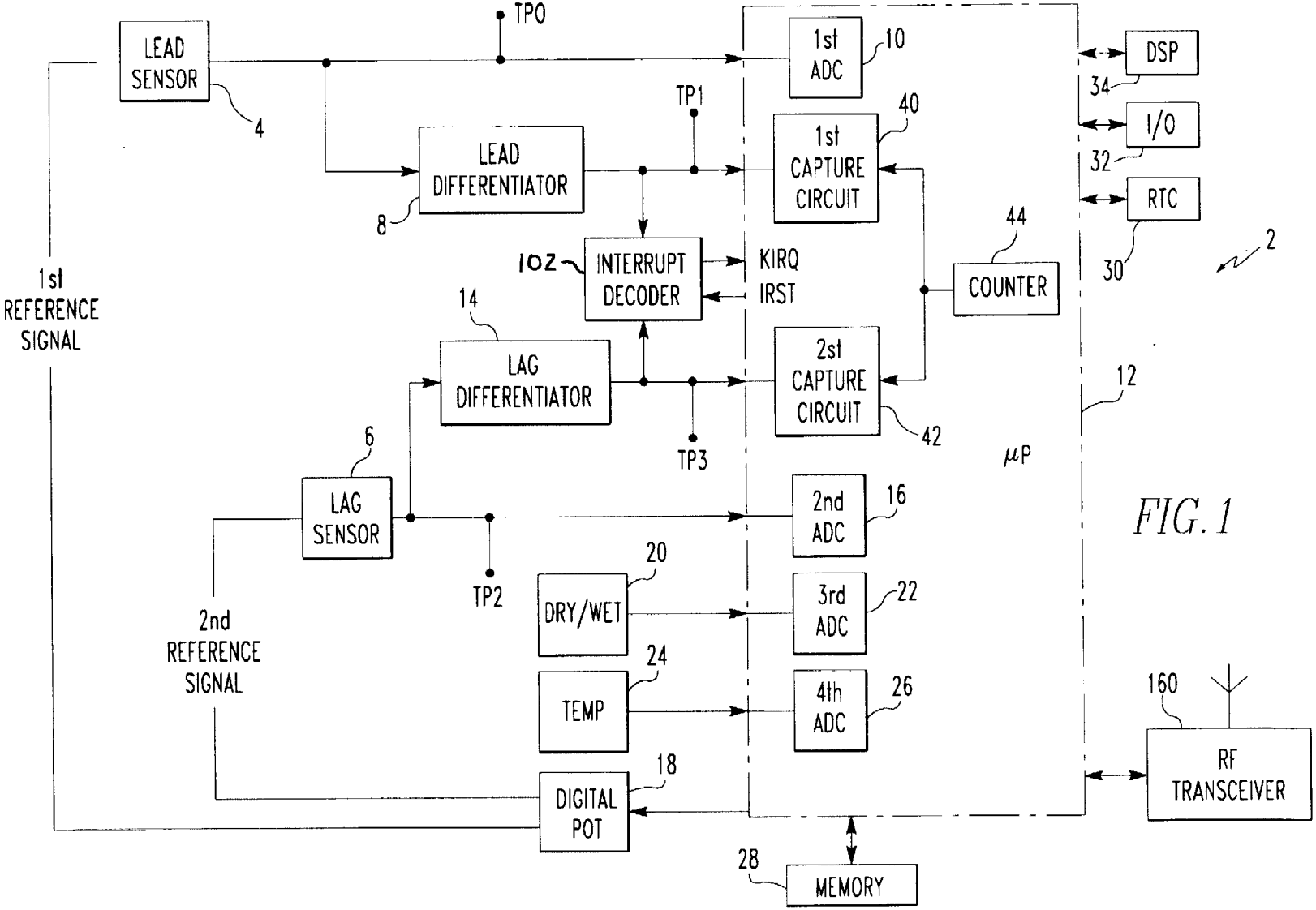
FIG. 1 is a block diagram illustrating the organization of circuitry for the Vehicle Magnetic Imaging (VMI) sensor of the present invention.

With reference to FIG. 1, a vehicle magnetic imaging sensor 2 is comprised of a first or lead magnetic field sensor 4 and a second or lag magnetic field sensor 6. The lead sensor 4 has an output connected to a lead differentiator 8 and a first analog-to-digital converter (ADC) 10 of a microprocessor 12. The lag sensor 6 has an output connected to a lag differentiator 14 and a second ADC 16 of the microprocessor 12. A compensator or digital potentiometer 18 is connected between an output of the microprocessor 12 and inputs of the lead sensor 4 and the lag sensor 6. The digital potentiometer 18 supplies reference signals, to be described in greater detail hereinafter, to each of the lead sensor 4 and the lag sensor 6 in response to the generation of command and control signals by the microprocessor 12. A dry/wet sensor 20 is connected to a third ADC 22 of the microprocessor 12. The dry/wet sensor 20 provides to the microprocessor 12 an indication of the presence or absence of moisture on a roadway. A temperature sensor 24 is connected to a fourth ADC 26 of the microprocessor 12 and provides to the microprocessor 12 an indication of the temperature of the roadway. The microprocessor 12 also includes other internal circuitry that is not shown in FIG. 1 for simplicity. The microprocessor 12 preferably has associated battery backed-up RAM memory 28, a real time clock (RTC) 30, input/output (I/O) circuitry 32 for programming and uploading of data stored in memory 28, and, optionally, a digital signal processor (DSP) 34. The electrical and electronic elements described so far are enclosed in a sealed enclosure (not shown) and are powered by rechargeable batteries stored in the enclosure.

In a preferred embodiment, the lead sensor 4 and the lag sensor 6 are spaced apart a selected distance, preferably, about 1–3 inches in a direction of travel of traffic. The lead sensor 4 generates a first or lead analog signal indicative of the change in the magnetic field strength adjacent the lead sensor 4 in response to the passage of a vehicle, such as a car, a truck, a bus, or other magnetically permeable masses, thereby. Similarly, the lag sensor 6 generates a second or lag analog signal indicative of the change in magnetic field strength adjacent the lag sensor 6 in response to the passage of the vehicle thereby.

The lead differentiator 8 differentiates the first analog signal generated by the lead sensor 4 and produces an output that changes binary states in response to detecting a predetermined change in the differentiated first analog signal output of the lead sensor 4. More specifically, the output of the lead differentiator 8 changes binary state when the derivative of the analog signal output by the lead sensor 4 changes to zero. The binary changing output of the lead differentiator 8 is provided to a first capture circuit 40 internal to the microprocessor 12. Similarly, the lag differentiator 14 differentiates the second analog signal generated by the lag sensor 6 and produces a binary changing output when the derivative of the analog signal output by the lag sensor 6 changes to zero. The binary changing output of the lag sensor 6 is provided to a second capture circuit 42 internal to the microprocessor 12.

The microprocessor 12 also includes a counter 44 that is connected to the first capture circuit 40 and the second capture circuit 42. The counter 44 is a register internal to the microprocessor 12 that accumulates values or counts at a predetermined rate or frequency $F_c$ preferably established by the RTC 30.

The changing logic levels of the lead differentiator 8 and the lag differentiator 14 are provided to the respective first capture circuit 40 and the second capture circuit 42. The first capture circuit 40 and second capture circuit 42 respond to the binary changing outputs of the respective lead differentiator 8 and lag differentiator 14 by reading the current value of the counter 44. Values of the counter read by the first capture circuit 40 and the second capture circuit 42 are stored in memory 28 for subsequent processing.

At an appropriate time, during or after the vehicle has passed, the microprocessor 12 retrieves from memory 28 the stored counter values obtained from the first capture circuit 40 and the second capture circuit 42 and converts the same into a first time series or lead profile and a second time series or lag profile, respectively. In one embodiment of the invention, the microprocessor 12 compares the lead profile or the lag profile to exemplary profiles stored in memory 28. Based on this comparison, the microprocessor 12 determines a characteristic of the vehicle, such as, without limitation, the length of the vehicle and/or if the vehicle is a car or a truck. Once determined, the microprocessor 12 accumulates and stores in memory 28 a count of like vehicles passing the lead sensor or the lag sensor. Alternatively, the microprocessor 12 simply accumulates and stores a count of vehicles determined to have passed the VMI sensor 2 without performing the above comparison.

In another embodiment, the microprocessor 12 detects spaced equivalent positions in the lead profile and the lag profile. When the spaced equivalent positions in the lead profile and the lag profile are detected, the microprocessor 12 calculates a speed of the vehicle as a function of the elapsed time between these spaced equivalent positions. Once calculated, the speed of the vehicle is accumulated and stored in the memory 28. Preferably, separate counts of vehicles traveling within predetermined speed ranges are stored in the memory 28.

In still yet another embodiment, the characteristic of the vehicle, e.g., vehicle length and/or vehicle type, and the speed of the vehicle can be determined in the above-described manners and separate counts of vehicle characteristics and vehicle speed are accumulated and stored in the memory 28.

From the foregoing, it should be appreciated that a VMI sensor for detecting characteristics of vehicles passing thereby can be formed from one magnetic sensor. However, if it is desired to detect the speed of a vehicle passing the VMI sensor 2, two spaced apart magnetic sensors are required.

Figure 2:
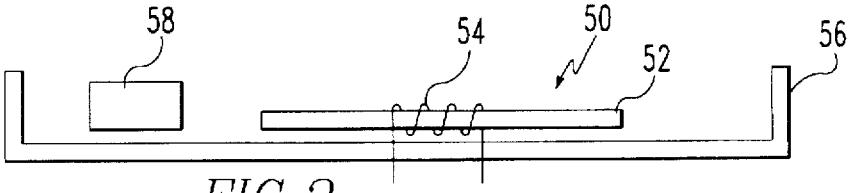
FIG. 2 is a side view of a magnetic detector (pick-up element) according to the invention.

With reference to FIG. 2, the lead sensor 4 and the lag sensor 6 each include a magnetic detector 50 comprised of a ferromagnetic strip 52 having a conductive winding wrap 54 thereabout. The ferromagnetic strip 52 is mounted to a base 56 and a small permanent magnet 58 is positioned on the base 56 adjacent one end of the strip 52. The magnetic flux density of the permanent magnet 58 and the position of the permanent magnet 58 adjacent one end of the ferromagnetic strip 52 are selected to bias the ferromagnetic strip 52 in a substantially linear range of its BH curve. The ferromagnetic strip 52 remains biased in the linear range of its BH curve regardless of the orientation of the ferromagnetic strip 52 in the earth's magnetic field and regardless of disturbance in the earth's magnetic field adjacent the ferromagnetic strip 52. The long axis of each ferromagnetic strip 52 is preferably oriented parallel to the direction of travel of the vehicle traffic. Features of the ferromagnetic strip 52 and of an enclosure for packaging the above-described electrical and electronic elements are described in greater detail in U.S. Pat. No. 5,408,179 to Sampey, et al., expressly incorporated herein by reference.

Figure 3:
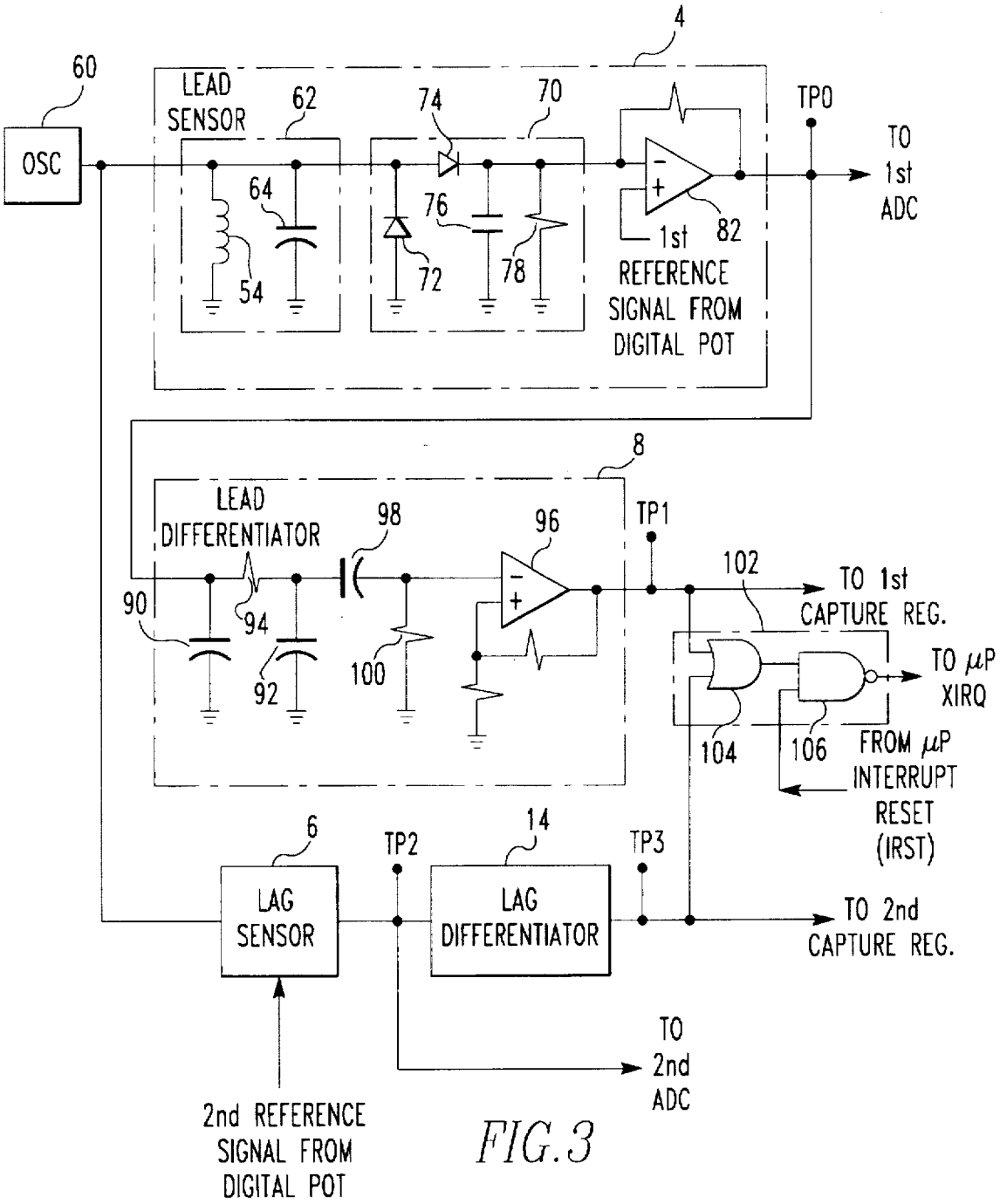
FIG. 3 is a generalized schematic diagram of the electronic circuit of the magnetic sensor according to the invention.

Referring to FIG. 3 and with continuing reference to FIG. 1, an oscillator 60 tuned to a select frequency, e.g., 100 KHZ, is connected to the lead sensor 4 and the lag sensor 6. The lead sensor 4 and the lag sensor 6 each include a tank circuit 62 that includes the winding 54 of the magnetic detector 50 and a capacitance 64 tuned to provide maximum impedance to the selected frequency of the oscillator 60. The output of the tank circuit 62 is connected to a demodulator 70 comprised of diodes 72, 74, filter capacitor 76 and resistor 78. When the ferromagnetic strip 52 detects a change in the earths magnetic field, the magnetic permeability of the ferromagnetic strip 52 increases or decreases. Because the inductance of winding 54 is proportional to the permeability of the ferromagnetic strip 52, a change in the magnetic permeability of the ferromagnetic strip 52 will produce a corresponding change in the inductance of the winding 54. A change in the inductance of the winding 54 produces a change in the frequency to which the tank circuit 62 is tuned. Thus, the impedance of the tank circuit 62 at the output of the oscillator 60 will decrease and the amplitude of the signal passed to the demodulator 70 will increase. Hence, the voltage on the capacitor 76 of the demodulator 70 will indicate the extent of the disturbance of the earth's magnetic field in the vicinity adjacent the ferromagnetic strip 52.

The demodulated signal output by demodulator 70 is provided to an inverting input of a difference amplifier 82. A noninverting input of the difference amplifier 82 is connected to one of the reference signals from the digital potentiometer 18. The difference amplifier 82 outputs a signal that is a difference between the demodulated signal from the demodulator 70 and the reference signal from the digital potentiometer 18.

The lead differentiator 8 and the lag differentiator 14 each include high frequency filter capacitors 90, 92 and a drop resistor 94 for matching the output of the sensor to an input of a Schmit trigger 96 of the differentiator. The differentiator also has a differentiating capacitor 98 and a bleed resistor 100 that provides to the Schmit trigger 96 the derivative of the output of the sensor. The output of the Schmit trigger 96 changes state in response to detecting the derivative of the sensor output changing to zero. The output of the Schmit trigger 96, however, changes state only when the derivative of the output of the sensor initially changes to zero. Thus, if the differentiated output of the sensor equals zero for an extended period of time, such as in the presence of a stationary vehicle positioned adjacent the sensor, the output of the differentiator will not continuously change state.

The first ADC 10 and the second ADC 16 are utilized by the microprocessor 12 to sample the outputs of the respective lead sensor 4 and the lag sensor 6 to determine if a shift in the inductance of the winding 54 has occurred in response to, for example, local magnetic conditions and/or a stationary magnetically permeable mass disturbing the earth's magnetic field near the lead sensor 4 or the lag sensor 6. If a shift in inductance is detected for a predetermined interval, the microprocessor 12 supplies a control signal to the digital potentiometer 18 to adjust the value of the first reference signal and/or the value of the second reference signal. Changing the value of the first reference signal and/or the second reference signal changes the bias on the noninverting input of the difference amplifier 82. Thus, the output of the lead sensor 4 and/or the lag sensor 6 can be adjusted to compensate for quiescent conditions, such as local magnetic conditions and/or a stationary magnetically permeable masses, such as a loose muffler or a large vehicle parked or stopped near the affected sensor.

Figure 4:
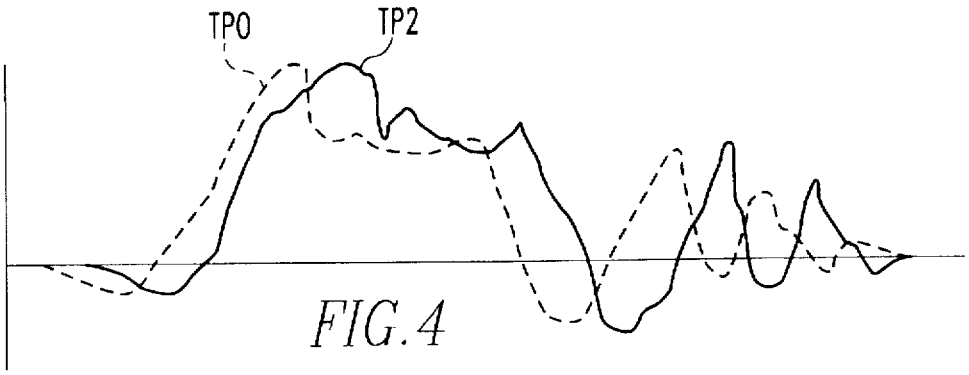
FIG. 4 illustrates exemplary intensity profiles for the lead sensor and lag sensor of the VMI sensor of FIG. 1.
Figure 5:
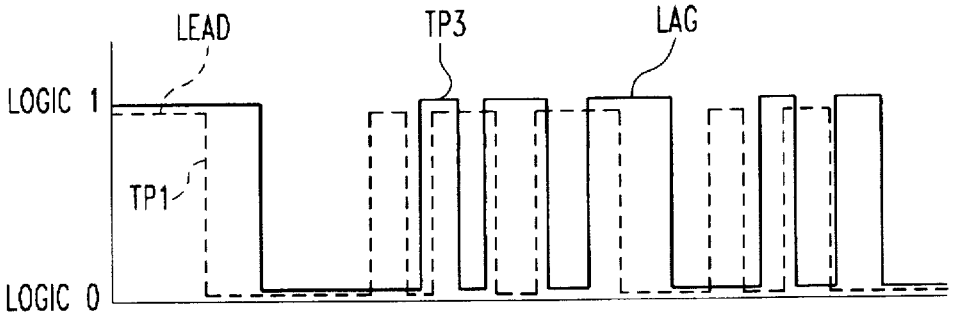
FIG. 5 illustrates exemplary outputs of the lead differentiator and lag differentiator of the VMI sensor of FIG. 1 when stimulated by the intensity profiles of FIG. 4.

With reference to FIGS. 4 and 5 and with continuing reference to FIGS. 1 and 3, the output of the lead sensor 4 in response to a passing vehicle is present at test point zero (TP0) and the output of the lag sensor 6 is present at test point 2 (TP2). As shown in FIG. 4, the signal at TP2 is shifted in time with respect to the signal at TP0. For illustration purposes, the signals at TP0 and at TP2 are shown as being slightly different. Each time the differentiated signal at TP0 changes to zero, the output of the lead differentiator 8, present at test point 1 (TP1), changes binary state, as shown in FIG. 5. Similarly, each time the differentiated signal at TP2 changes to zero, the output of the lag sensor 6, present at test point 3 (TP3), changes state. While illustrated as having a logic 1 starting value, the starting value of the outputs of the differentiators 8 and 14, present at TP1 and TP3, could also be logic 0. In FIG. 5, the signal levels at TP1 and TP3 are shown as being shifted in amplitude for illustration purposes.

An advantage of utilizing the capture circuits 40 and 42 is the capability to sample the output of the differentiators approximately every 8 microseconds. This is in contrast to the first ADC 10 and the second ADC 16 which sample the output of the sensors approximately every 250 microseconds. Thus, the first capture circuit 40 and the second capture circuit 42 are able to sample the outputs of the lead differentiator 8 and the lag differentiator 14 an order of magnitude more often than the first ADC 10 and the second ADC 16 are able to sample the output of the lead sensor 4 and the lag sensor 6. This increase sampling rate and the detection of binary changing signal levels, versus analog signals, enables production of well-defined lead series profile and lag series profile corresponding to the vehicle being measured. This results in enhanced vehicle characterization and improved speed detection over the prior art.

Figure 6:
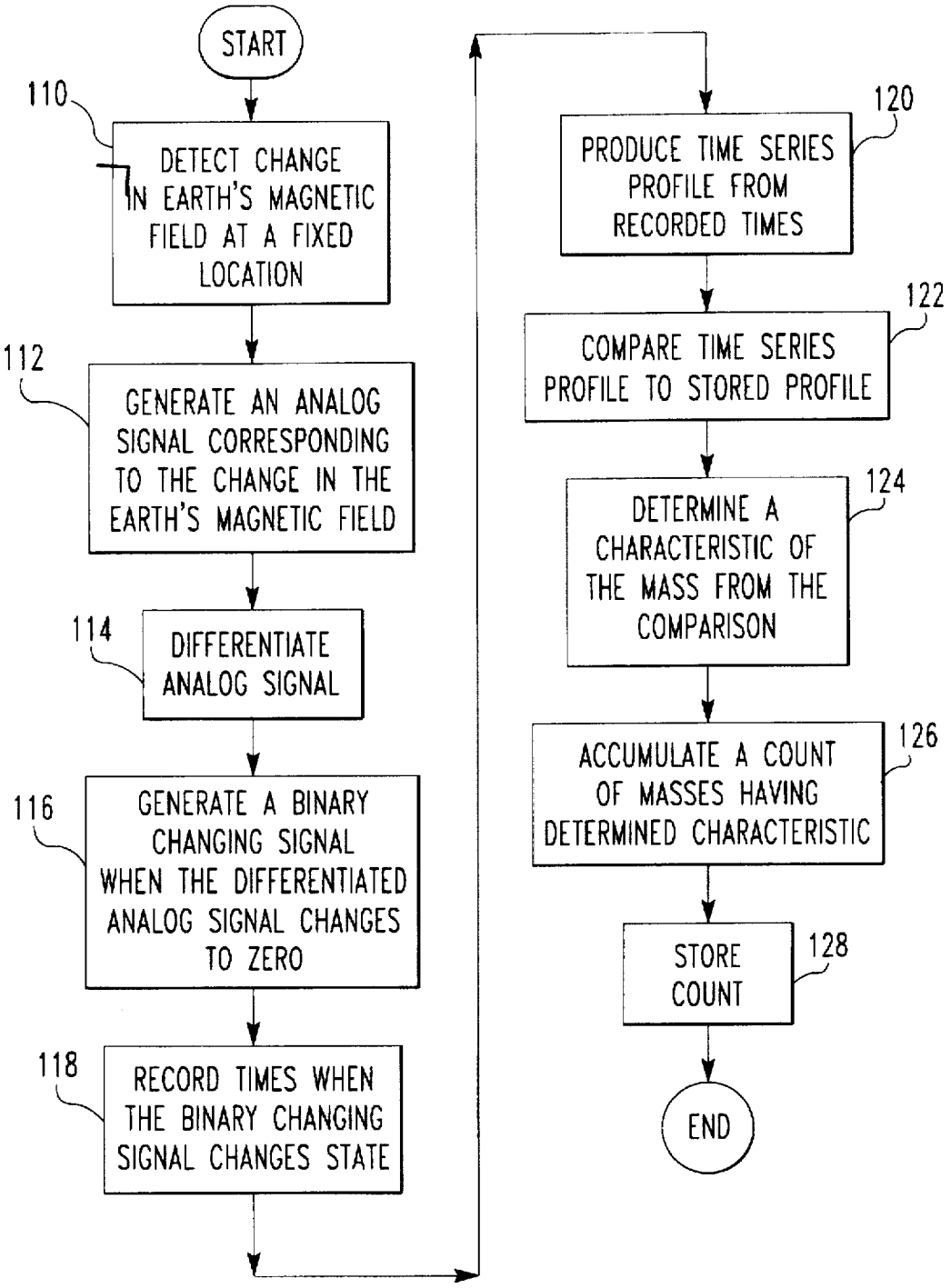
FIG. 6 is a diagrammatic illustration of the procedure for determining a characteristic of a magnetically permeable mass.

With reference to FIG. 6, a flow chart illustrating a method for determining a characteristic of a magnetically permeable mass is provided. At step 110, a change in the earth's magnetic field is detected at a fixed location. An analog signal corresponding to the change in the earth's magnetic field is generated at step 112. The analog signal is differentiated at step 114. At step 116 a binary changing signal is generated when the differentiated analog signal changes to zero. The times when the binary changing signal changes state are recorded at step 118. At step 120 a time series profile is produced from the recorded times. The time series profile is compared to a stored profile at step 122 and, at step 124, a characteristic of the mass is determined from the comparison. A count of masses having the determined characteristic is determined at step 126 and the count is stored at step 128.

Figure 7:
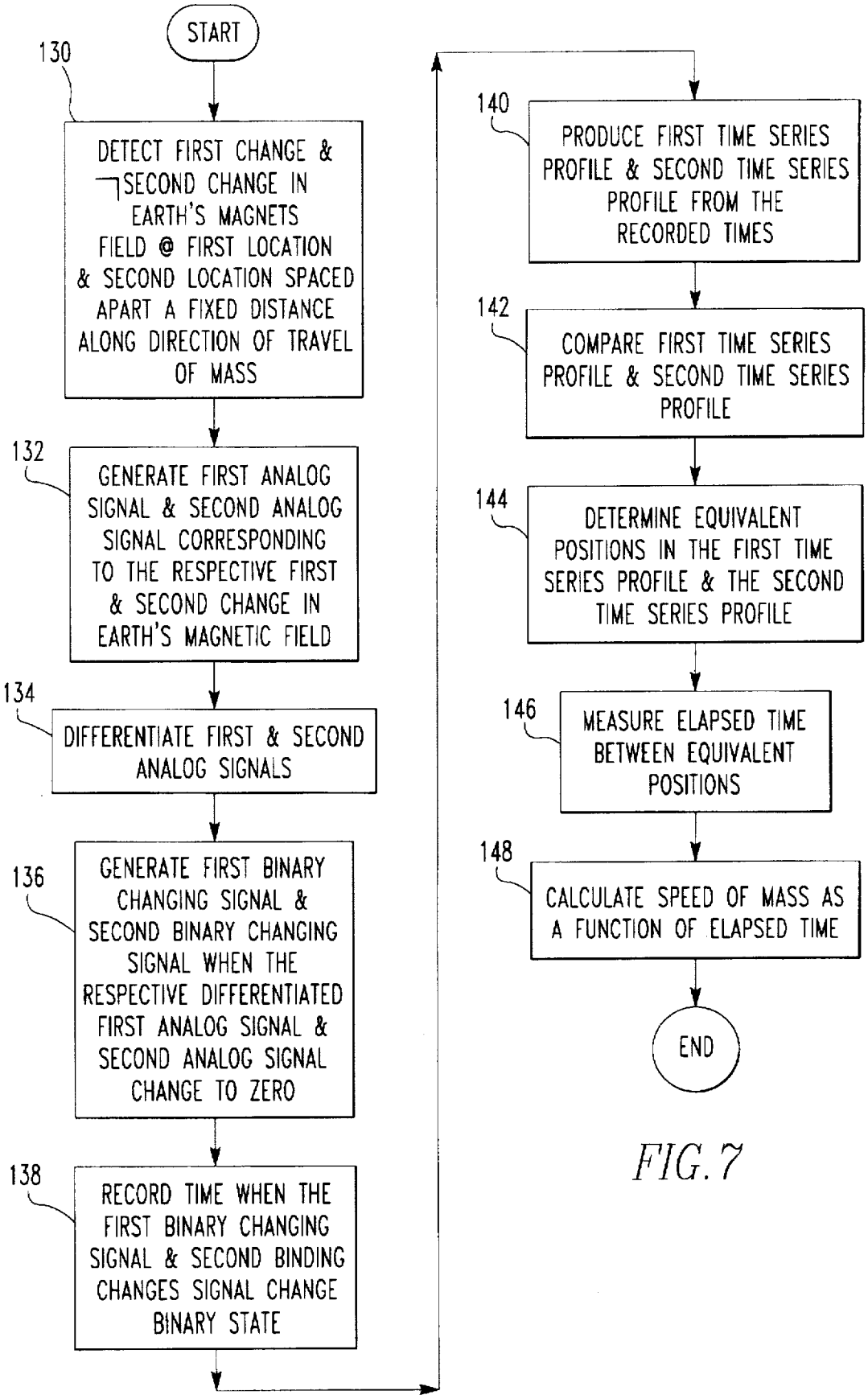
FIG. 7 is a diagrammatic illustration of the procedure for detecting the velocity of a magnetic permeable mass.

With reference to FIG. 7, a flow chart illustrating a method for determining a speed of a magnetically permeable mass is provided. In step 130 a first change and a second change in the earth's magnetic field are detected at a first location and a second location spaced apart a fixed distance along a direction of travel of the mass. At step 132, a first analog signal and a second analog signal are generated corresponding to the respective first change and second change in the earth's magnetic field. The first analog signal and the second analog signal are differentiated at step 134. At step 136, a first binary changing signal and a second binary changing signal are generated when the respective differentiated first analog signal and second analog signal change to zero. The times when the first binary changing signal and the second binary changing signal change binary state are recorded at step 138. At step 140 a first time series profile and a second time series profile are produced from the recorded times of the respective first binary changing signal and the second binary changing signal. The first time series profile and the second time series profile are compared at step 142 and equivalent positions in the first time series profile and the second time series profile are determined at step 144. At step 146, the elapsed time between the equivalent positions are measured and, at step 148, the speed of the mass is calculated as a function of the elapsed time.

Referring back to FIGS. 1 and 2, in a preferred embodiment, the microprocessor 12 is a Motorola 68HC711E9. Preferably, the microprocessor 12 is configured to enter into a low power or sleep mode in the absence of vehicles passing adjacent the sensors 4, 6 within a predetermined interval of time. In this manner, the battery contained in the enclosure is preserved. When a vehicle passes by the lead sensor 4 and/or the lag sensor 6, the microprocessor 12 is awakened from its sleep mode by an interrupt request received from the output of one or both of the differentiators. More specifically, in addition to being provided to the capture circuits 40 and 42, the outputs of the differentiators 8 and 14 are provided to an interrupt decoder 102. The interrupt decoder 102 includes an OR gate 104 and a NAND gate 106. The inputs of the OR gate 104 receive the outputs of differentiators 8 and 14. The output of the OR gate 104 is provided to an input of the NAND gate 106. In response to receiving an interrupt request from the NAND gate 106, the microprocessor 12 awakens from its sleep mode and begins processing vehicle data related to the passing vehicle.

The other input of the NAND gate 106 is connected to an interrupt reset (IRST) output of the microprocessor 12. The interrupt reset output establishes an appropriate logic level at the input to the NAND gate 106 so that the interrupt request is provided to the microprocessor in response to the output of the differentiators changing state regardless of the starting state of the output of the differentiators.

Figure 8:
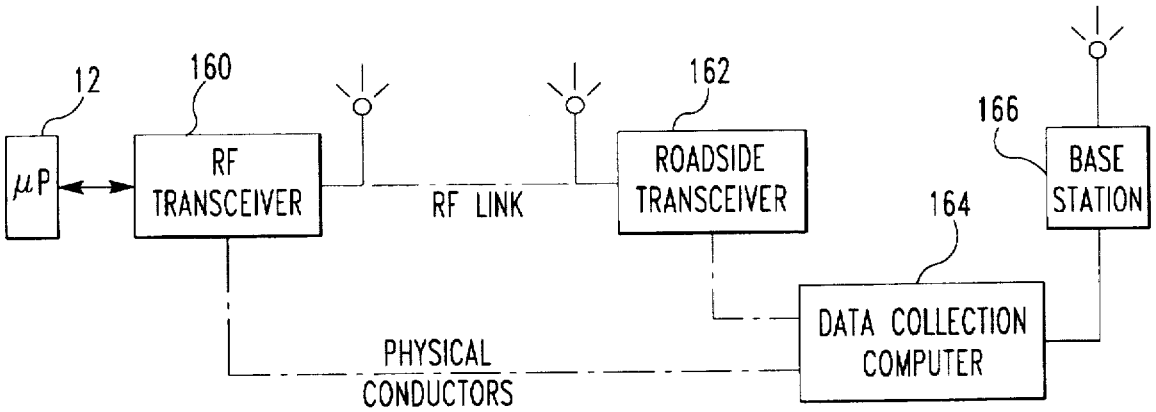
FIG. 8 is a block diagram of an RF communications network for communicating information between the VMI sensor of FIG. 1 and a remote data collection computer.

With reference to FIG. 8 and with continuing reference to FIG. 1, in use, the above-described VMI sensor 2 is affixed to a road surface or is buried beneath the road surface. Because the VMI sensor 2 has limited memory 28, it is necessary to occasionally transfer the information stored therein to a data collection computer 164 for analysis. Heretofore, the information stored in the VMI sensor 2 is transferred to the data collection computer 164 via physical conductors (shown in phantom in FIG. 8) connectable between the microprocessor 12 and the collecting computer 164. A problem with utilizing physical conductors, however, is the need to run the conductors between the VMI sensor 2 and the data collection computer 164. This is particularly a problem on busy roadways or in applications where the VMI sensor 2 is buried beneath the roadway. Another problem with utilizing physical conductors is the need for periodic visits to the installed VMI sensor 2 to collect the data. To overcome the above problems, and others, the present VMI sensor 2 of the present invention includes a radio frequency (RF) transceiver 160 that is utilized to communicate data between the VMI sensor 2 and a roadside transceiver 162.

As shown in FIG. 1, the RF transceiver 160 is connected to receive data and command signals from the microprocessor 12. Because the VMI sensor 2 is battery powered, the output of the RF transceiver 160 is limited. Thus, it is necessary to have the roadside transceiver 162 located near, e.g., 30 meters, the VMI sensor 2 to receive the RF output from the RF transceiver 160.

In one embodiment, the roadside transceiver 162 is connected, as shown in phantom in FIG. 8, to a data collection computer 164 carried in a vehicle. To collect information from the VMI sensor 2, the data collection computer 164 and the roadside transceiver 162 are moved into range of the RF transceiver 160 of the VMI sensor 2. A suitable download command is transmitted from the data collection computer to the VMI sensor 2 via the roadside transceiver 162 and the RF transceiver 160. In response to receiving the download command, the microprocessor 12 of the VMI sensor 2 causes the RF transceiver 160 to transmit to the data collection computer 164 the collected data. An advantage of this embodiment is the lack of physical conductors between the VMI sensor 2 and the programmable computer.

In another embodiment, a fixed site roadside transceiver 162 is positioned within the range of the RF transceiver 160 of the VMI sensor 2. Preferably, the roadside transceiver 162 includes a signal booster that enables communication of the VMI sensor 2 and a base station 166. The roadside transceiver 162 includes processing circuitry that receives command and control signals from the base station 166. These command and control signals are utilized to cause the VMI sensor 2 to transfer the data stored in memory 28 to the roadside transceiver 162 via RF transceiver 160. The roadside transceiver 162, in turn, receives the data from the VMI sensor 2 and communicates the data to the base station 166. The data received by the base station 166 is routed to the data collection computer 164 for suitable processing. An advantage of this embodiment is that one fixed site roadside transceiver 162 can be utilized to communicate data between the base station 166 and one or more RF transceivers. Moreover, a network of RF transceivers 160 and roadside transceivers 162 can be utilized to provide to the base station 166 indications of vehicle movement at a plurality of different locations. This is particularly advantageous for evaluating traffic patterns over a wide geographical region.

Accordingly, the present invention provides an improved VMI sensor 2 and method for detecting vehicle characteristics and for detecting a speed of a vehicle. Moreover, the present invention provides an apparatus for communicating vehicle information and speed data from the VMI sensor 2 to a data collection computer 164 that avoids physical connectors between the VMI sensor 2 and the data collection computer 164.

The invention has been described in connection with the preferred embodiments. Obvious modification and alterations will occur to others upon reading and understanding the preceding detailed description. For example, the direction of vehicles passing the vehicle magnetic imaging sensor 2 can be determined by evaluating which of the first sensor 4 and the second sensor 6 first generates an analog signal in response to the passage of the vehicle. Thus, if the first sensor 4 generates an analog signal in advance of the second sensor 6 generating an analog signal, the vehicle is traveling in a first direction. Conversely, if the second sensor 6 generates an analog signal in advance of the first sensor 4 generating an analog signal, the vehicle is traveling in a second direction opposite the first direction. It is intended that the invention be construed as including all such modifications and alterations insofar as they come with the appended claims with the equivalents thereof.

Having described the preferred embodiment the invention is now claimed to be:

1. An apparatus for detecting vehicles passing a fixed position, the apparatus comprising:

a first magnetic field detector for generating a first analog signal indicative of changes in magnetic field strength adjacent the first detector in response to a vehicle passing thereby;

a differentiating circuit for differentiating the first analog signal and for producing a first output that changes binary states in response to detecting a predetermined change in the differentiated first analog signal;

a counter which accumulates values at a predetermined rate; and a processor for storing a counter value for each change in the binary state of the first output of the differentiating circuit, for converting into a first time series profile the stored counter values corresponding to the changes in the first output of the differentiating circuit and for accumulating and storing a count of passing vehicles.

2. The apparatus as set forth in claim 1 wherein the processor utilizes the first time series profile to characterize the passing vehicles and wherein the count is related to the characterization of the passing vehicles.

3. The apparatus as set forth in claim 1 further including:

a second magnetic field detector for generating a second analog signal indicative of changes in magnetic field strength at the second detector in response to the vehicle passing thereby, the second detector spaced apart from the first detector along the direction of travel of the vehicle, wherein the processor determines the direction of the vehicle by determining which of the first magnetic field detector and the second magnetic field detector first detects a change in magnetic field strength in response to the vehicle passing thereby.

4. The apparatus as set forth in claim 1 further including a communications circuit for wirelessly communicating data stored therein from the fixed position to a remote data collector.

5. The apparatus as set forth in claim 1 further including:

a second magnetic field detector for generating a second analog signal indicative of changes in magnetic field strength at the second detector in response to the vehicle passing thereby, the second detector spaced apart from the first detector along the direction of travel of the vehicle, wherein;

the differentiating circuit differentiates the second analog signal and produces a second output that changes binary states in response to detecting a predetermined change in the differentiated second analog signal output; and the processor stores a counter value for each change in the binary state of the second output of the differentiating circuit, converts into a second time series profile the stored counter values corresponding to the changes in the second output of the differentiating circuit, detects spaced equivalent positions in the first time series profile and the second time series profile, measures an elapsed time between the spaced equivalent positions and calculates a speed of the vehicle from the elapsed time between the spaced equivalent positions.

6. The apparatus as set forth in claim 5 wherein the count is related to one or more of the length, the type and the speed of the passing vehicles.

7. The apparatus as set forth in claim 5 wherein at least one of the first and second magnetic field detectors comprise:

a ferromagnetic strip having a conductive winding wrapped thereabout;

a permanent magnet positioned to bias the ferromagnetic strip in a substantially linear part of its BH curve, wherein the magnetization of the ferromagnetic strip remains in the substantially linear part of the BH curve regardless of the orientation of the ferromagnetic strip in the earth's magnetic field and regardless of disturbance in the earth's magnetic field; and a sensing circuit for sensing a change in inductance of the conductive winding in response to disturbance in the earth's magnetic field adjacent the ferromagnetic strip and for producing the analog signal output indicative of the change in inductance.

8. The apparatus as set forth in claim 7 wherein the sensing circuit is comprised of:

an oscillator for generating a signal on an output thereof;

a tank circuit tuned to a selected frequency and having an input connected to receive the oscillator output, wherein the tank circuit is comprised of the conductive winding; and a demodulator circuit for demodulating a signal output by the tank circuit and for producing the analog signal output indicative of the change in inductance.

9. The apparatus as set forth in claim 5 wherein the processor detects the output of at least one of the first magnetic field detector and the second magnetic field detector and determines therefrom one of the presence and absence of a stationary magnetically permeable mass adjacent the at least one of the first magnetic field detector and the second magnetic field detector.

10. A sensor for detecting a moving magnetically permeable mass by disturbance of the earth's magnetic field adjacent the sensor, the sensor comprising:

a ferromagnetic strip having a conductive winding wrapped thereabout;

a permanent magnet positioned to bias the ferromagnetic strip in a substantially linear part of its BH curve, wherein the magnetization of the ferromagnetic strip remains in the substantially linear part of the BH curve regardless of the orientation of the ferromagnetic strip in the earth's magnetic field and regardless of a disturbance in the earth's magnetic field;

a sensing circuit for sensing a changing inductance of the conductive winding in response to a moving magnetically permeable mass disturbing the earth's magnetic field adjacent the ferromagnetic strip and for producing an analog signal output indicative of the changing inductance;

a differentiating circuit for differentiating the analog signal output of the sensing circuit and for producing an output that changes binary states in response to detecting a predetermined change in the analog signal output of the sensing circuit;

a counter for accumulating values at a predetermined frequency;

a capture circuit for storing the current value of the counter in response to a change in binary state of the output of the differentiating circuit; and a processor for processing the stored count to characterize the permeable mass.

11. The sensor as set forth in claim 10 wherein the sensing circuit includes:

an oscillator for generating a signal on an output thereof;

a tank circuit tuned to a selected frequency and having an input connected to receive the oscillator output, wherein the tank circuit is comprised of the conductive winding; and a demodulator circuit for demodulating an output signal of the tank circuit and for producing the analog signal output indicative of the change in inductance.

12. The sensor as set forth in claim 10 wherein the differentiating circuit includes a Schmit trigger output.

13. The sensor as set forth in claim 10 wherein the sensing circuit senses a change in the inductance of the winding in response to one of local magnetic conditions and a stationary magnetically permeable mass disturbing the earth's magnetic field adjacent the ferromagnetic strip and produces a level shifted analog signal output indicative of the change in inductance.

14. The sensor as set forth in claim 13 further including an ADC for detecting the level shifted analog signal output and determining therefrom the presence of the stationary magnetically permeable mass.

15. The sensor as set forth in claim 14 further including a compensator for compensating the level shifted analog signal output of the sensor for the one of the local magnetic conditions and the presence of the stationary magnetically permeable mass disturbing the earth's magnetic field adjacent the ferromagnetic strip.

16. The sensor as set forth in claim 15 wherein the compensator adjusts a bias of the level shifted analog signal output of the sensor as a function of a quiescent condition there of.

17. A method of determining a characteristic of a magnetically permeable mass passing a fixed position, the method comprising the steps of:

detecting a change in the earth's magnetic field at a fixed position in response to a magnetically permeable mass passing thereby;

generating an analog signal corresponding to the change in the earth's magnetic field;

differentiating the analog signal;

generating a binary changing signal that changes binary state in response to each occurrence of the slope of the differentiated analog signal changing to zero;

recording times when the binary changing signal changes the binary state;

producing a time series profile from the recorded times; and determining from the time series profile if a mass has passed the fixed position.

18. The method as set forth in claim 17 further including the steps of:

comparing the time series profile to a stored profile; and determining from the comparison a characteristic of the mass.

19. The method as set forth in claim 17 further including the steps of:

accumulating a count of magnetically permeable masses passing the fixed position; and storing the count.

20. A method of determining a speed of a magnetically permeable mass, the method comprising the steps of:

detecting a first change and a second change in the earth's magnetic field at respective first and second locations in response to a magnetically permeable mass passing thereby, the first and second locations spaced a fixed distance apart along the direction of travel of the magnetically permeable mass;

generating first and second analog signals corresponding to the respective first change and second change in the earth's magnetic field;

differentiating the first analog signal and second analog signal;

generating a first binary changing signal and a second binary changing signal that change binary state in response to each occurrence of the slope of the respective differentiated first analog signal and second analog signal changing to zero;

recording times when the first binary changing signal and second binary changing signal change the binary state;

producing a first time series profile and a second time series profile from the recorded times;

comparing the first time series profile and second time series profile;

determining equivalent positions in the first time series profile and second time series profile;

measuring an elapsed time between the equivalent positions; and calculating the speed of the mass as a function of the elapsed time.

* * * * *